United States Patent [19]

Sevastakis

[11] Patent Number: 4,901,783

[45] Date of Patent: Feb. 20, 1990

[54] CONTINUOUS CASTING APPARATUS

[76] Inventor: Gus Sevastakis, 5645 Angola Rd., Toledo, Ohio 43615

[21] Appl. No.: 342,636

[22] Filed: Apr. 20, 1989

Related U.S. Application Data

[63] Continuation of Ser. No. 687,503, Jan. 4, 1985, abandoned, which is a continuation of Ser. No. 466,619, Feb. 15, 1983, abandoned.

[51] Int. Cl.[4] ..... B22D 11/04

[52] U.S. Cl. ..... 164/421

[58] Field of Search ..... 164/421

[56] References Cited

PUBLICATIONS

Perry, Robt. H. et al., Eds., *Chemical Engineers' Handbook,* 5th Ed. (McGraw-Hill, 1973), pp. 3-99 and 3-100.

*Primary Examiner*—Kurt Rowan

*Attorney, Agent, or Firm*—Barnes, Kisselle, Raisch, Choate, Whittemore & Hulbert

[57] ABSTRACT

A continuous casting apparatus wherein molten metal flows through a die progressively and is solidified in the die and withdrawn from the die comprising a die and cooling assembly including a tubular die having an external tapered surface which is uniformly tapered radially inwardly in the direction of movement of metal to the die, a cooling sleeve having an internal surface complementary to the external surface of the die and in substantial intimate surface contact with the external surface of the die, an annular cooling shell surrounding the cooling sleeve and having portions thereof spaced from the sleeve to define a cooling chamber, and at least one inlet to the chamber, at least one outlet from the chamber. The tubular die has an internal surface which is uniformly tapered radially inward in the direction of movement of metal to the die such that as the molten metal flows progressively through the die and is solidified and contracts, substantially intimate contact is maintained between the internal surface of the tubular die and the solidified metal so that improved heat transfer is achieved. The tubular die has a greater external diameter before assembly than the internal diameter of the cooling sleeve before assembly and the cooling sleeve is shrunk fit on the tubular die such that the tubular die is in compression at ambient temperature and the strength of the die is increased and such that as the cooling sleeve temperature increases in usage, intimate contact is maintained between the cooling sleeve and the die.

4 Claims, 3 Drawing Sheets

CONTINUOUS CASTING APPARATUS

This application is a continuation of application Ser. No. 687,503, filed Jan. 4, 1985, which is, in turn, a continuation of application Ser. No. 466,619 filed Feb. 15, 1983, now both abandoned.

This invention relates to continuous casting.

BACKGROUND AND SUMMARY OF THE INVENTION

In continuous casting of metals such as brass and the like, it is common to permit molten metal to flow from a crucible through a die which is surrounded by a cooling apparatus so that the molten metal progressively solidifies and is withdrawn by suitable apparatus. A major consideration in the efficiency of such a device is the ability to remove heat from the product being formed.

More specifically, as the molten metal moves through the outlet of the die, the cooling sleeve absorbs heat from the metal through the die, thereby reducing the temperature of the metal. The metal begins to solidify at the inside surface of the die in what is known as a freezing zone.

Conventionally, the dies are made of fine grade graphite which will with stand the temperature of the molten metal to a high degree of 4000° F. For example, copper melts at about 1941° F. and has a liquidus state at 1981° F.

The metal is initially cooled at a greater extent on the exterior surface of the product being formed and progressively cooled radially inwardly until it solidifies. The cooling occurs as the metal is moved from the inlet to the outlet of the die. As the metal solidifies, the outside diameter moves toward the center of the product being cast and away from the inside diameter of the forming die. As the product being formed moves towards the exit of the die and away from the freezing zone, it no longer has an intimate contact with the die and is only cooling by radiation.

If the speed of movement of the product through the die is slow, the freezing zone will be at a higher level inside the forming die resulting in slow production and increased friction between the inside diameter of the product and the mandrel in case of tubular products. Also, in many cases where the product being formed is not symmetrical in cross section so that the cooling is not uniform, the product will deform away from the casting center line of the forming die increasing the chances of damage to the die wall at the exit area. It is thus necessary that the product move out of the freezing zone in a short period of time and away from the mandrel forming section in order to secure uniform wall thickness without forming stress cracks or changes in the molecular structure on the outside diameter of the products being cast.

In order to provide intimate contact between the die and the cooling sleeve, it is common to provide a taper on the external surface of the die and a complementary taper on the internal surface of the cooling sleeve. In one method of assembly, the die and cooling sleeve are forced together axially. In another method of assembly, the die is revolved as it is assembled to the cooling sleeve in an effort to obtain more intimate contact between the die and the sleeve.

Another problem in continuous casting relates to the thickness of the graphite die or mold. For each nominal outside diameter of product being cast there is an inside calculated diameter of a cooling sleeve and the thickness of the graphite mold must be sufficient to accommodate the hydrostatic pressures and the friction type pressure between the formed products and the inside surface of the die without at the same time reducing the thermal conductivity of the die. Thus, appropriate thickness of the wall of a small diameter die (e.g. 2.00 inch) may be ¼ of an inch. The wall thickness of the graphite die will be increased according to the outside diameter of the products being formed to compensate for the hydrostatic pressure. On the other hand, the strength of a graphite die decreases as the temperature rises up to 2000° F. so it is common to compensate for the loss of strength by increasing the thickness of the graphite mold. However, the thermal conductivity of the graphite die is much less than that of the cooling sleeve. Thus, although increasing the thickness of the graphite will increase the strength of the die, it will decrease the thermal conductivity of the die walls.

Where the product being formed is tubular further problems exist because the interior surface will not be cooled at the same rate as the exterior.

Where the tubular product has a thick wall, the inside surface of the product is usually very inconsistent in diameter and surface finish. Because of the inability to cool the outer and inner wall surfaces properly and the longer period for withdrawing the product from the die due to the large mass of metal, the metal is in a very molten stage when leaving the straight portion of the mandrel and the low melting metal constituents such as lead, tin and zinc are not solidified and migrate to the outside surface. At this stage the product cools very slowly from the outside to the inside and by the time the product leaves the end of the mandrel, the low melting constituents are still in a molten stage and migrate and solidify on the inside diameter of the product with very large irregularities. Often, the remaining molten metal extrudes through partially solidified metal resulting in interruption of the casting. The disadvantage of not cooling both surfaces with the same rate reduces the rate of production and results in defective tubular products. Thus, it would be very advantageous to form the products with a similar rate of cooling at the internal diameter and external diameter.

Accordingly, among the objectives of the present invention are to provide a continuous casting apparatus and method of making the apparatus which improves the transfer of heat from the metal being cast thereby increasing the quality and production rates and wherein when forming heavy walled tubular products the cooling of the outside surface and the inside surface is similar thereby obviating the problems inherent in making such products.

In accordance with the invention, the tubular die has an internal surface which is uniformly tapered radially inward in the direction of movement of metal to the die such that as the molten metal flows progressively through the die and is solidified and contracts, substantially intimate contact is maintained between the internal surface of the tubular die and the solidified metal so that improved heat transfer is achieved. In addition, the tubular die has a tapered external surface with greater external diameters before assembly than the internal diameters of the mating tapered surface of the cooling sleeve before assembly and the cooling sleeve is shrunk fit on the tubular die such that the tubular die is in compression at ambient temperature and the strength of the die is increased and such that as the cooling sleeve temperature increases in usage, causing expansion thereof intimate contact is maintained between the cooling sleeve and the die. Where a heavy walled tubular product is being formed, a cooled mandrel is provided to facilitate the cooling of the internal surface of the tubular product being formed. The mandrel preferably includes a tapered lower end constructed and arranged to maintain intimate contact with the internal surface of the tubular product being formed.

DESCRIPTION

Figure 1:
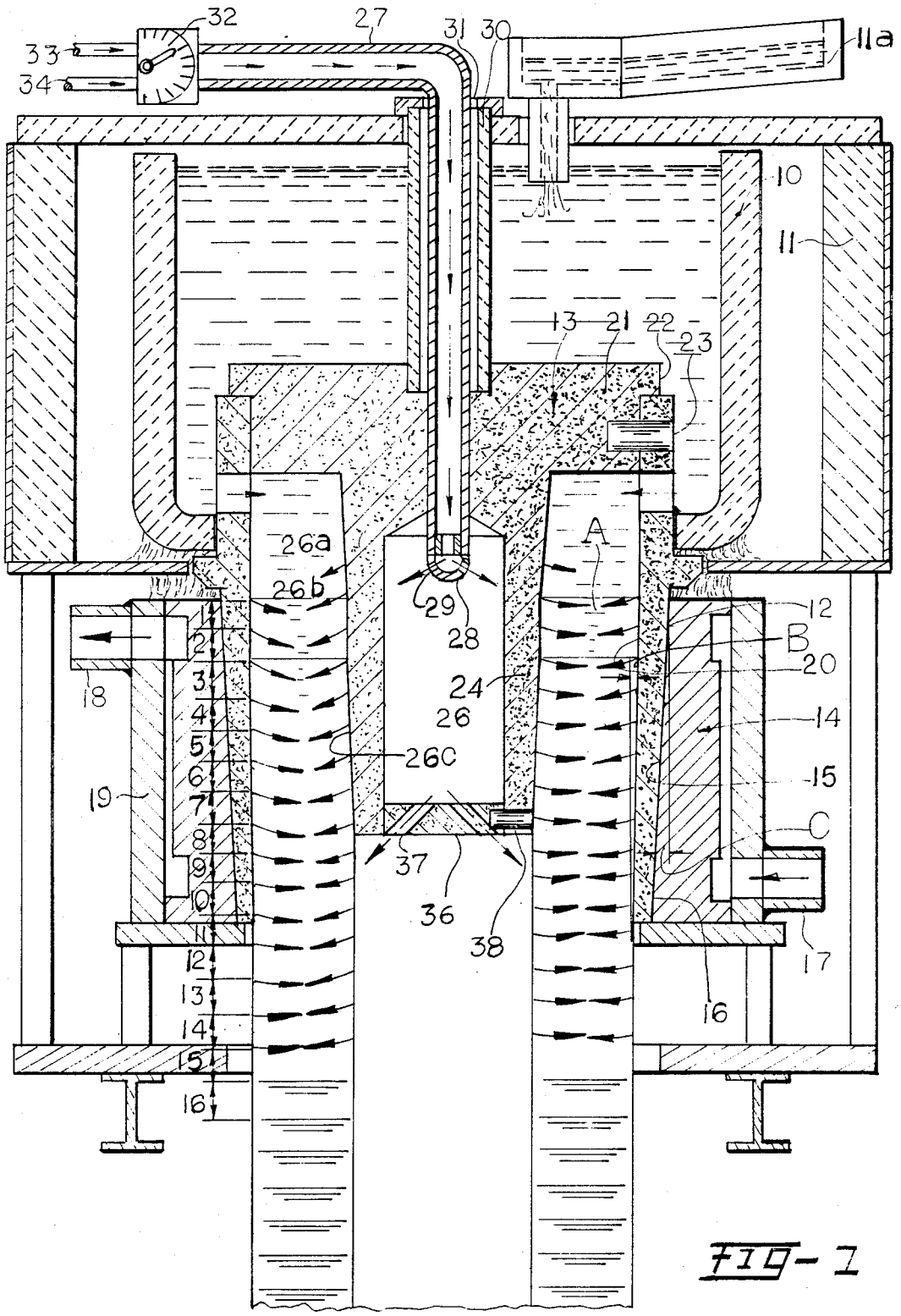
FIG. 1 is a longitudinal sectional view of a continuous casting apparatus embodying the invention for making tubular products.

Referring to FIG. 1, the invention relates to a continuous casting apparatus which conventionally includes a crucible 10 supported on a furnace 11 that contains molten metal and is kept heated by burners not shown. The molten metal flows through the upper end of a die and cooling assembly. More specifically, a trough 11*a* supplies the molten metal that flows through the upper end of a die 12 and as it moves through the die 12 progressively solidifies and is withdrawn by intermittently driven withdrawal apparatus such as pinch rolls, not shown. A mandrel 13 is provided in the event that tubular forms are being made. The die 12 and mandrel 13 are made of graphite.

The cooling subassembly of the die and cooling assembly includes a metal cooling sleeve 14 that has an internal tapered surface 15 at angle C complementary to the outer die surface 16 so that there is substantial intimate surface-tosurface contact between the tapered surfaces 15, 16 of the die 12 and the cooling sleeve 14. The cooling sleeve 14 is made of a material having a greater coefficient of expansion that the coefficient of expansion of the material of the tubular die 12.

The cooling sleeve 14 includes a liquid inlet 17 and a liquid outlet 18 for circulation of liquid coolant between the sleeve 14 and outer wall 19 of the subassembly.

In accordance with the invention, the internal surface 20 of the die 12 is tapered progressively and inwardly from the freezing zone A spaced from the molten metal inlet, at which the metal beings to solidify, to the outlet sufficiently to maintain intimate contact between the product being formed as it further solidifies and contracts in moving from the inlet to the outlet. The degree of taper, angle B, is determined by considering the diameter of the product being formed, the coefficient of shrinkage of the products, which is assumed to be the same as the coefficient of expansion, the length of the die 12 inside the cooling sleeve 14, the change in temperature of the metal as it moves from the freezing zone to the outlet of the die. If the coefficient of shrinkage increases, the degrees of taper is increased. If the length of the die is increased the degree of taper is decreased. If the outlet temperature is lessened, the degree of taper is increased. By making the internal surface of the die so that it tapers radially inwardly, it is possible to maintain contact with the solidified metal at all times so that the rate of heat extraction is increased and the efficiency improved.

Further, in accordance with the invention, the external diameter of the die 12 prior to assembly at ambient temperature is greater than the complementary internal diameter of the cooling sleeve 14 at ambient temperature. In accordance with the invention, the sleeve 14 is heated to a temperature above the operating temperature of the die and coating sleeve during the casting operation, for example, about 300° F., the operating temperature being under 212° F., and then assembled with the die 12 permitting the cooling sleeve 14 to contract and placing the die 12 under compression. This not only reinforces and strengthens the die but insures that, at operating temperatures, upon expansion of the cooling sleeve 14, an intimate heat transfer contact is maintained between the internal surface of the cooling sleeve 14 and the external surface of the die 12.

In determining the extent to which the external diameter of the die should be greater than the internal diameter of the sleeve, the factors that affect the change in dimension including the coefficient of expansion of the cooling sleeve 14, the inside diameters of the cooling sleeve 14, the working temperatures, and the like are taken into consideration so that at the operating temperatures, the desired intimate contact will be maintained.

Mandrel 13 includes an upper wall 21 having a peripheral flange 22 that rests on the upper edge of die 12 and is retained by a graphite pin 23. Mandrel 13 further includes an integral portion 24 that projects within die 12. The center part of the mandrel has a cavity 26 that extends from above the freezing zone A to below the freezing zone A. A steel tube 27 is inserted and extends downward through the upper wall 21 of the mandrel 13 and has a closed end 28 with small holes 29 for directing air or liquid coolant or a mixture thereof radially against the inside of the walls of cavity 26. A ceramic tube 30 surrounds and protects the steel tube 27. The tube 27 is protected with a ceramic cap 31 at the upper end to avoid contact with the molten metal. When the product is being formed and operating conditions have been stabilized cooling air is first introduced through a selector and mixer valve 32 that controls flow from liquid and air coolant lines 33, 34 to the tube 27 to cool the inside of the mandrel cavity 26. As conditions continue a mixture of air and liquid coolant or liquid coolant alone is directed to the chamber 26 by adjustment of the selector valve 32. A plug 36 is provided at the bottom of cavity 26 and is retained by a graphite pin 38. Plug 36 includes openings 37 for directing the coolant against the inside surface of the tubular product being formed to further increase the productivity.

Once the forming process has begun and operating conditions have been stabilized, the forming operation can be summarized as follows; the arrows representing the solidification of the metal.

Mandrel 26 has an outer surface including a first tapered upper portion 26*a* to strengthen the upper portion of the mandrel and assist in the start-up of the operations. At start-up the outlet end is closed and metal solidifies at the lower end and tapered portion 26*a* permits the molten metal to break away from the mandrel. The mandrel includes an intermediate cylindrical surface portion 26*b* which determines the internal diameter of the product being formed. Finally, in accordance with the invention, the mandrel includes a tapered surface 26c extending downwardly from the freezing zone which has a lesser taper than prior mandrels calculated such as to maintain contact with the internal surface of the product being formed. The degree of taper is determined such that heat transfering contact is maintained to the lower end of the mandrel. The taper is calculated taking into consideration, the length of the mandrel, the temperatures of the metal at the upper and lower ends of the mandrel and the shrinkage of the metal as it solidifies in moving from the freezing zone to the free end of the mandrel.

The metal initially starts to cool and a thin skin or layer is formed on the inside diameter toward the center of the wall thickness. The cavity of the mandrel extends over the freezing line and the inside skin or layer starts forming above the freezing zone. When the metal is at the same height as the freezing zone, the solidified skin of the metal from outer and inner surfaces of the tubular wall moves towards the center of the wall thickness. By the time the metal is below the freezing zone the wall is well supported from both sides and moves uniformly downwards. The mandrel at the lower end is tapered inwardly to insure the free flow of the product downwardly.

Thus, a solidifying skin is formed on the outer and inner surfaces of the tubular wall and, as a result the low melting constituents such as lead, tin and zinc are solidified in place and they do not migrate to the surface of the product. It has been known that heavy wall bronze bars have a greater segregation of lead and the like on the inside diameter. As a result, it has been common to provide excess metal on the inside diameter which would be removed to clean the segregated metal. The present invention permits an increase in the quality, production efficiency and reduction of segregated constituents at the surfaces.

The resultant product has improved outside and inside finish and the stress cracks on the inside and outside diameters are eliminated.

The manner in which the provision of a taper 20 functions to improve the efficiency can be understood with reference to an example.

Molten bronze metal enters the upper part of the die 12 at a temperature of about 1950° F. The job is started and all the variables are stabilized so that the casting bar is drawn with the intermittent mechanism (not shown) such as intermittent stroke length of about ½" and a linear speed of the mechanism such as 36" a minute.

As the metal starts to solidify at the freezing zone, the arrows representing solidification point toward the center of the casting body in both directions. At this point the formed skin of solidified metal moves towards the molten metal at the center of the wall and the skin at the inside and the skin at the outside are at the same level.

It can be seen that at the upper end of the die, the metal is supported from both sides at the cylindrical portion of the die. It is this portion of the die that determines the wall and outside diameter of the bar at solidified state, which in the case of bronze is about 1800° F. At intermediate positions, the bar tends to move away from both surfaces. Although the center hole of the bar becomes smaller, the taper 26c on the mandrel permits downward movement toward the exit of the die. As the bar fully solidifies it tends to move away from the wall of the die and shrinks towards the inside diameter. For example, to make the 6"×3"bar, the diameter of the die cavity is 6.090" and the mandrel 3.039" at the freezing zone. At the end of the seventh stroke, the bar is at temperature 1100° F. and the outside diameter should measure 6.055". At position 10, the bar is coming out of the die the temperature of 1000° F. and a diameter of 6.049". The inside diameter is 3.020".

In order to maintain intimate contact at all times between the formed bar and the die where the cooler is 6" high, total of 0.041" taper is required from the freezing zone which is at the top of the cooling sleeve toward the exit of the die (0.041" total for a 6" outer diameter).

Figure 2:
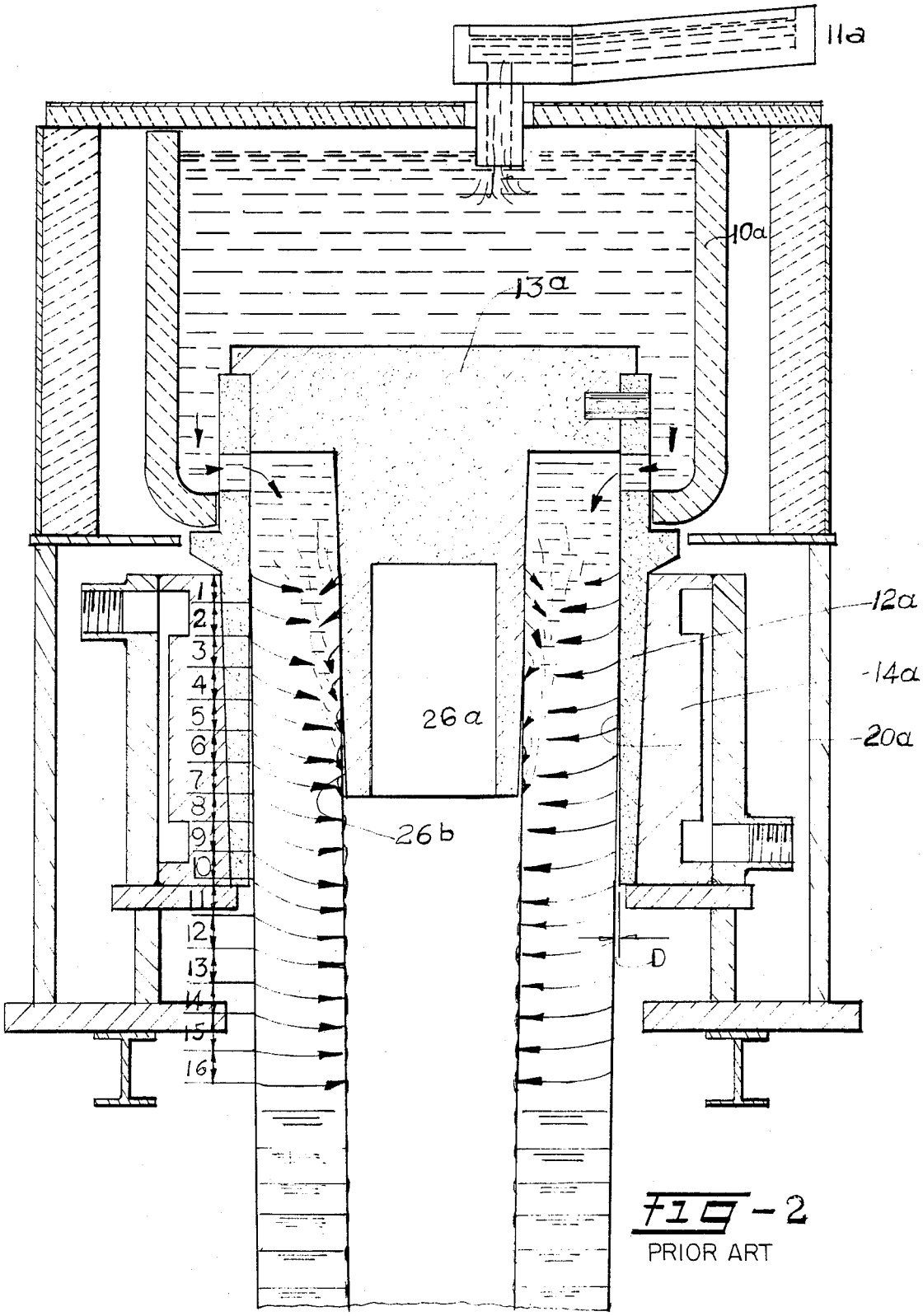
FIG-2 PRIOR ART
FIG. 2 is a longitudinal sectional view of a prior art continuous casting apparatus for making tubular products.

The invention may be contrasted to the prior art shown in FIG. 2 which does not incorporate the structure of the tapered surface 20, the shrink fit between the cooling sleeve 14a and tubular die 12a and the cooled mandrel 13a.

At position 1, when the metal starts to solidify, the arrows representing solidification point toward the center of the casting body in both directions. At this point the formed skin of solidified metal moves towards the liquid metal at the center of the freezing zone.

At position 2, the metal tends to pull away from the mandrel and away from the die cavity 20a with less liquid metal at the center of the wall.

At position 3, the longer arrows represent further solidification from the outside. The cooling sleeve absorbs more temperature from die 12a than outside diameter of the mandrel. The mandrel 13a cools only by convection or air circulation from the cavity 26a. The inside arrows representing solidification bend toward the center of the bar showing the contracting forces of solidified metal. The mandrel is tapered inward at 26b to allow the inside diameter to move free and out of contact.

At position 4, the inside arrows bend more away from the center of the bar and the center hole starts to close in diameter and to support the molten metal, inside the wall. The outside arrows increased in length and strength, representing further solidification and contraction of the formed products.

At position 5, the inside arrows move toward the inside diameter of the tubular product and the outside arrows extend through the total thickness of the bar indicating almost complete solidification of the wall thickness.

At position 6, the inside arrows disappear and the outside arrows move toward the center of the bar. At positions 7 and 8, the product shrinks further away from the inside diameter of the graphite die as at gap D.

At the exit or outlet of the die, the bar is at about 1000° F. with some red color and is moving away continuously from the inside diameter of the die and towards the outside diameter of the mandrel.

It can be seen that at positions 1 and 2, the metal is supported from both sides at the cylindrical portion of the die. It is this portion of the die that determines the wall and outside diameter of the bar at solidified state of the bronze (1800° F.). At positions 3 to 6, the bar tends to move away from outer surfaces. Although the center hole of the bar becomes smaller, the taper 26b on the mandrel permits downward movement toward the exit of the die. At position 7, the bar is solid tending to move away from the die and shrinks towards the inside diameter. At the end of the seventh stroke, the bar is at temperature 1100° F. and the outside diameter should be 6.055". At position 9, the bar is coming out of the die at the temperature of 1000° F., the outside diameter of the bar being 6.049" and the inside diameter 3.020". At this point, an air gap of 0.020" is formed between the inside surface of die 12*a* and the product.

At all the other strokes at positions from 9 to 14, the stock moves toward the center, and at the end of the fourteenth stroke with an after cooler, the bar is at a normal room temperature and measures 6.000" OD by 3.000" ID.

It can be seen that the arrows after the eighth stroke are changing direction toward the center and in a reduced angle toward the horizontal lines of the stock cooling rings.

As a result of this solidification, rapid and and efficient production is diminished.

Figure 3:
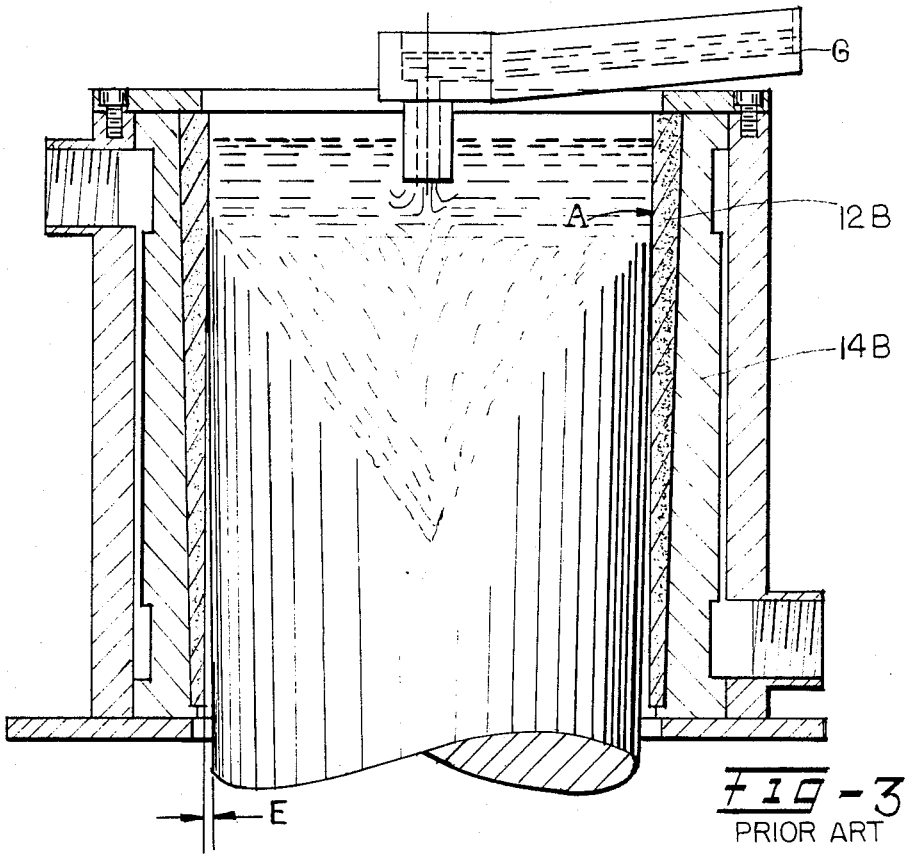
FIG-3 PRIOR ART
FIG. 3 is a longitudinal sectional view of a prior art continuous casting apparatus for making solid products.

The problems of movement of the metal away from the die as it solidifies occur also in prior art casting apparatus as shown in FIG. 3 for making solid products such as solid bars. Such apparatus comprises a die 12*b* having an outer tapered surface and an inner cylindrical surface and a sleeve 14*b* having a tapered inner surface but does not incorporate a tapered surface 20 or the shrink fit between the cooling sleeve and tubular die, as in the form of the invention shown in FIG. 1. As shown, the metal tends to solidify and contract forming a gap E resulting in loss of heat transfer contact between the internal surface of the die 12*b* and the product being formed.

Figure 4:
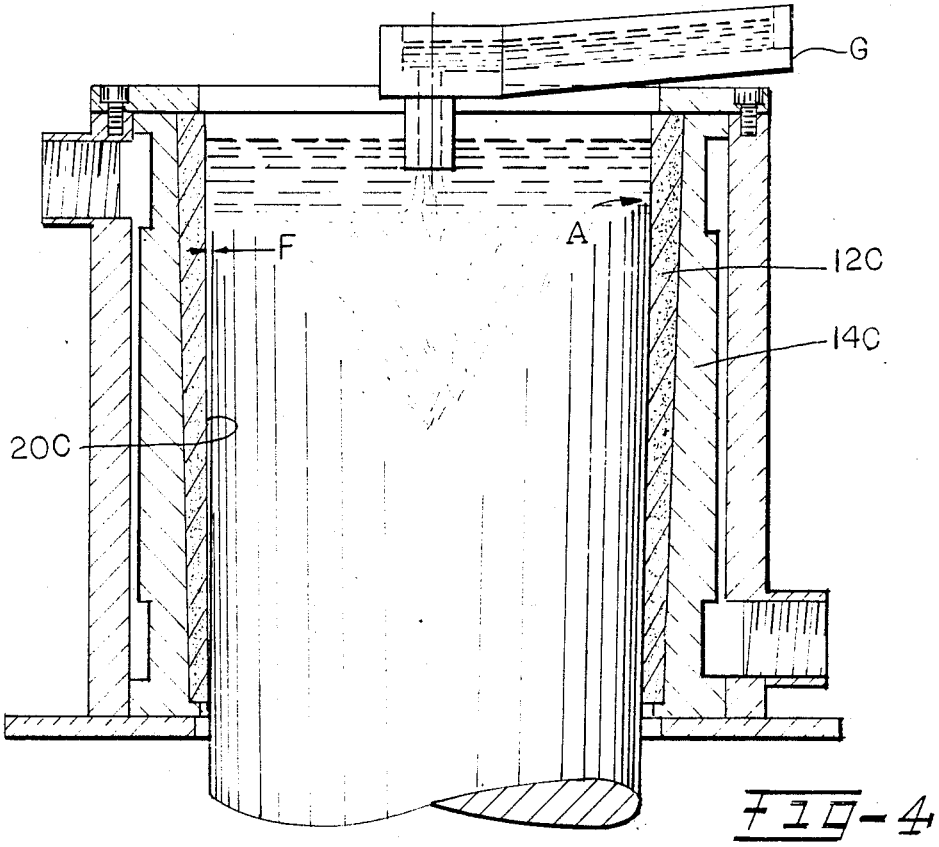
FIG. 4 is a longitudinal sectional view of a modified form of continuous casting apparatus embodying the invention for making solid products.

The invention can also be applied to a continuous casting apparatus to form a solid bar such as shown in FIG. 4 utilizing an open die 12*c*. As in the casting of a tubular product, the internal surface 20C of die 12C is tapered at an angle F from freezing zone A where the metal begins to solidify to the outlet sufficient to maintain contact with the solid bar. The sleeve 14C is shrunk fit on the die 12C as in the form shown in FIG. 1.

I claim:

1. In a continuous casting apparatus wherein molten metal flows through a die progressively and is solidified in the die and withdrawn from the die, a die and cooling assembly comprising a tubular die having an external tapered surface which is uniformly tapered radially inwardly in the direction of movement of metal to the die, a cooling sleeve having an internal surface adapted to be complementary to the external surface of the die and in substantial intimate surface contact with the external surface of said die, an annular cooling shell surrounding said cooling sleeve and having portions thereof spaced from said sleeve to define a cooling chamber, the cooling sleeve being made of a material having a greater coefficient of expansion than the coefficient of expansion of the material of said tubular die, at least one inlet to said chamber, at least one outlet from said chamber, said tubular die having an internal surface which is uniformly tapered radially inward in the direction of movement of metal to the die such that as the molten metal flows progressively through the die and is solidified and contracts, substantially intimate contact is maintained between the internal surface of the tubular die and the solidified metal so that improved heat transfer is achieved, the tapered external surface of said tubular die having greater external diameters at ambient temperature before assembly and at operating temperature after assembly than the corresponding tapered internal surface of the cooling sleeve at ambient temperature before assembly and at operating temperature after assembly such that when said cooling sleeve is heated to a temperature above the operating temperatures of the die and cooling sleeve, telescoped over the tubular die, and permitted to cool and be shrunk fit on said tubular die, the tubular die is in compression at both ambient and operating temperatures and when the die and cooling sleeve is utilized at operating temperatures, the tubular die remains in compression and intimate contact is maintained between the cooling sleeve and the tubular die at the operating temperatures, the diameter of the cooling sleeve being determined by the factor of the coefficient of expansion of the sleeve and the temperature of the sleeve at the operating temperatures so that upon expansion, the internal surface of the cooling sleeve will maintain contact with the external surface of the die, a mandrel associated with said tubular die for forming tubular products, said mandrel including an internal chamber to which said coolant is directed, said mandrel including openings in the end thereof for directing said coolant from said chamber toward the interior surface of the product being formed;

said mandrel including a tapered external surface extending from the freezing zone such that substantial intimate contact is maintained by the tapered surface with the internal surface of the tubular product being formed.

2. The continuous casting apparatus set forth in claim 1 wherein the taper of the internal surface of the tubular die is determined by the factors of coefficient of expansion of the die, diameter of the die, coefficient of expansion and contraction of the metal being continuously cast, and the temperatures to which the die is subjected in use such that the inward taper of the internal surface will be substantially that corresponding to the shrinkage of the molten metal as it solidifies and contracts in moving from the inlet to the outlet.

3. In a continuous casting apparatus wherein molten metal flows through a die progressively and is solidified in the die and withdrawn from the die, a die and cooling assembly comprising a tubular die having an external tapered surface which is uniformly tapered radially inwardly in the direction of movement of metal to the die, a cooling sleeve having an internal surface adapted to be complementary to the external surface of the die and in substantial intimate surface contact with the external surface of said die, an annular cooling shell surrounding said cooling sleeve and having portions thereof spaced from said sleeve to define a cooling chamber, the cooling sleeve being made of a material having a greater coefficient of expansion than the coefficient of expansion of the material of said tubular die, at least one inlet to said chamber, at least one outlet from said chamber, said tubular die having an internal surface which is uniformly tapered radially inward in the direction of movement of metal to the die such that as the molten metal flows progressively through the die and is solidified and contracts, substantially intimate contact is maintained between the internal surface of the tubular die and the solidified metal so that improved heat transfer is achieved, the tapered external surface of said tubular die having greater external diameters at ambient temperature before assembly and at operating temperature after assembly than the corresponding tapered internal surface of the cooling sleeve at ambient temperature before assembly and at operating temperature after assembly such that when said cooling sleeve is heated to a temperature above the operating temperatures of the die and cooling sleeve, telescoped over the tubular die, and permitted to cool and be shrunk fit on said tubular die, the tubular die is in compression at both ambient and operating temperatures and when the die and cooling sleeve is utilized at operating temperatures, the tubular die remains in compression and intimate contact is maintained between the cooling sleeve and the tubular die at the operating temperatures, the diameter of the cooling sleeve being determined by the factor of the coefficient of expansion of the sleeve and the temperature of the sleeve at the operating temperatures so that upon expansion, the internal surface of the cooling sleeve will maintain contact with the external surface of the die, a mandrel associated with said tubular die for forming tubular products, said mandrel including a tapered external surface extending from the freezing zone such that substantial intimate contact is maintained by the tapered surface with the internal surface of the tubular product being formed.

4. In a continuous casting apparatus wherein molten metal flows through a die progressively and is solidified in the die and withdrawn from the die, a die and cooling assembly comprising a tubular die having an external tapered surface which is uniformly tapered radially inwardly in the direction of movement of metal to the die, a cooling sleeve having an internal surface adapted to be complementary to the external surface of the die and in substantial intimate surface contact with the external surface of said die, an annular cooling shell surrounding said cooling sleeve and having portions thereof spaced from said sleeve to define a cooling chamber, the cooling sleeve being made of a material having a greater coefficient of expansion than the coefficient of expansion of the material of said tubular die, at least one inlet to said chamber, at least one outlet from said chamber, said tubular die having an internal surface which is uniformly tapered radially inward in the direction of movement of metal to the die such that as the molten metal flows progressively through the die and is solidified and contracts, substantially intimate contact is maintained between the internal surface of the tubular die and the solidified metal so that improved heat transfer is achieved, a mandrel associated with said tubular die for forming tubular products, said mandrel including a tapered external surface extending from the freezing zone such that substantial intimate contact is maintained by the tapered surface with the internal surface of the tubular product being formed.

* * * * *